United States Patent [19]
Idstein

[11] 4,437,754
[45] Mar. 20, 1984

[54] APPARATUS FOR TRANSFERRING TONER IMAGES

[75] Inventor: Hermann Idstein, Oestrich-Winkel, Fed. Rep. of Germany

[73] Assignee: Hoechst Aktiengesellschaft, Frankfurt am Main, Fed. Rep. of Germany

[21] Appl. No.: 413,544

[22] Filed: Aug. 31, 1982

[30] Foreign Application Priority Data

Sep. 16, 1981 [DE] Fed. Rep. of Germany ..... 3136659

[51] Int. Cl.³ ..... G03G 15/00
[52] U.S. Cl. ..... 355/3 TR; 355/3 SH; 355/14 TR; 101/DIG. 13
[58] Field of Search ..... 355/3 TR, 14 TR, 3 TE, 355/3 SH, 14 SH; 118/661, 621; 430/126, 199; 156/240; 101/91, 83, 93.21, 93.24, 113, 132, 467, DIG. 13, DIG. 15

[56] References Cited

U.S. PATENT DOCUMENTS

| | | | |
|---|---|---|---|
| 3,591,276 | 7/1971 | Byrne | 355/3 |
| 4,014,605 | 3/1977 | Fletcher | 355/3 TR |
| 4,087,169 | 5/1978 | Fantuzzo | 355/3 TR |
| 4,182,266 | 1/1980 | Alston | 118/621 |
| 4,214,831 | 7/1980 | Reesen | 355/3 R |
| 4,257,700 | 3/1981 | Tsuda et al. | 355/3 TR |
| 4,268,157 | 5/1981 | Ebi et al. | 355/3 TR |
| 4,316,666 | 2/1982 | Ceelen | 355/3 TR |
| 4,327,991 | 5/1982 | Takeuchi et al. | 355/3 SH |

FOREIGN PATENT DOCUMENTS

| | | |
|---|---|---|
| 2930568 | 2/1980 | Fed. Rep. of Germany . |
| 2925379 | 1/1981 | Fed. Rep. of Germany . |
| 1424128 | 2/1976 | United Kingdom . |

*Primary Examiner*—A. C. Prescott
*Attorney, Agent, or Firm*—Schwartz, Jeffery, Schwaab, Mack, Blumenthal & Koch

[57] ABSTRACT

Apparatus for transferring a toner image from a photoconductor to an image carrier with means to synchronize the speed of the photoconductor and image carrier during toner image transfer. The image carrier is held on the circumferential surface of a transport cylinder and is urged against the circumferential surface by a pressure roller. The photoconductor lies on an upper part of a travelling table which is moved towards the transport cylinder. During the forward motion, the upper part of the travelling table is connected with a travelling table via locking members but as soon as the upper part of the travelling table comes into contact with the image carrier, the locking members open and allow an easy displacement of the upper art of the travelling table with respect to the travelling table.

17 Claims, 7 Drawing Figures

APPARATUS FOR TRANSFERRING TONER IMAGES

BACKGROUND OF THE INVENTION

1. Field of the Invention

The present invention relates to an apparatus for transferring toner images from a moving photoconductor to an image carrier which is fastened to a rotating cylinder.

2. Description of the Prior Art

When a toner image is transferred from a moving photoconductor to a moving image carrier, it is necessary to avoid any difference in speed between the photoconductor and the image carrier during the transfer operation, in order to obtain a high image quality. Generally, when the image carrier comprises paper, a plastic film or a similar material, transfer is effected with the aid of pressure heat and/or with the assistance of a corona discharge. As long as the thickness of the image carrier is always the same and in particular is so small that it is negligible compared to the radius of a cylinder on the circumference of which the photoconductor is mounted, there are hardly any problems of slip occurring between the photoconductor and the image carrier.

From U.S. Pat. No. 3,554,836 a transfer process for toner images is known, in which a toner image is developed on a silicone elastomer surface and is then transferred once or even more than once to further silicone elastomer surfaces and is eventually applied to the final image carrier, without splitting of the toner. In the process, an aluminum plate coated with a silicone elastomer may, for example, be used to form the shell of a roll, on which an image is present, which is developed by means of a developer. The developed image can subsequently be transferred to another roll which is also coated with a silicone elastomer and, from this roll, it is finally transferred to an image carrier web.

U.S. Pat. No. 4,092,925 describes an apparatus of a printing plate system comprising a recyclable printing member of aluminum to which a photosensitive coating is applied, which constitutes the image face together with the aluminum printing member. The aluminum printing member is supported by a carrier plate and is releasably connected thereto. Upon completion of the printing operation, the aluminum printing member is separated from the carrier plate which can also be reused.

In connection with the known apparatuses for the image transfer, the problem of synchronous running between the photoconductor and an image carrier which is mounted on a drum is not mentioned.

SUMMARY OF THE INVENTION

It is an object of the present invention to provide an apparatus for transferring toner images from a photoconductive surface to an image carrier. In such a transfer, it is desired to obtain a synchronous running between the image carrier and the photoconductive surface which is moved at a predetermined speed and carries the toner image to be transferred. The transfer takes into account different thicknesses of various image carriers and specific tolerances for any given thickness.

In order to achieve this object in accordance with the present invention, the apparatus comprises (a) a cylinder mounted for rotation, (b) means for securing at least a portion of said image carrier about the circumferential surface of said cylinder, (c) a support table having an upper portion thereof supporting said photoconductor, said upper portion movable in a linear fashion adjacent said cylinder, (d) means for mounting said cylinder and table for pressure contacting said image carrier and said photoconductor upon movement of said upper portion of said table, and (e) means for synchronizing the linear speed of said upper portion of said table with the tangential speed of said image carrier secured to said cylinder.

The upper portion of the table is relatively movable with respect to the table. Preferably rolling members are positioned between the table and the upper portion. The synchronizing means comprises a gear wheel mounted for rotation with the cylinder and a mating rack mounted to the table.

The invention has the advantage that no braking or accelerating forces are exerted on the photoconductive surface by the image carrier, since the image carrier runs synchronously with the photoconductive surface. Consequently, one may avoid damage to the photoconductive surface and increased wear thereof and also losses in the quality of the transferred image.

BRIEF DESCRIPTION OF THE DRAWINGS

In the text which follows, the invention is explained in detail with reference to an embodiment shown in the drawings, wherein.

DETAIL DESCRIPTION OF THE PREFERRED EMBODIMENT

Figure 1:
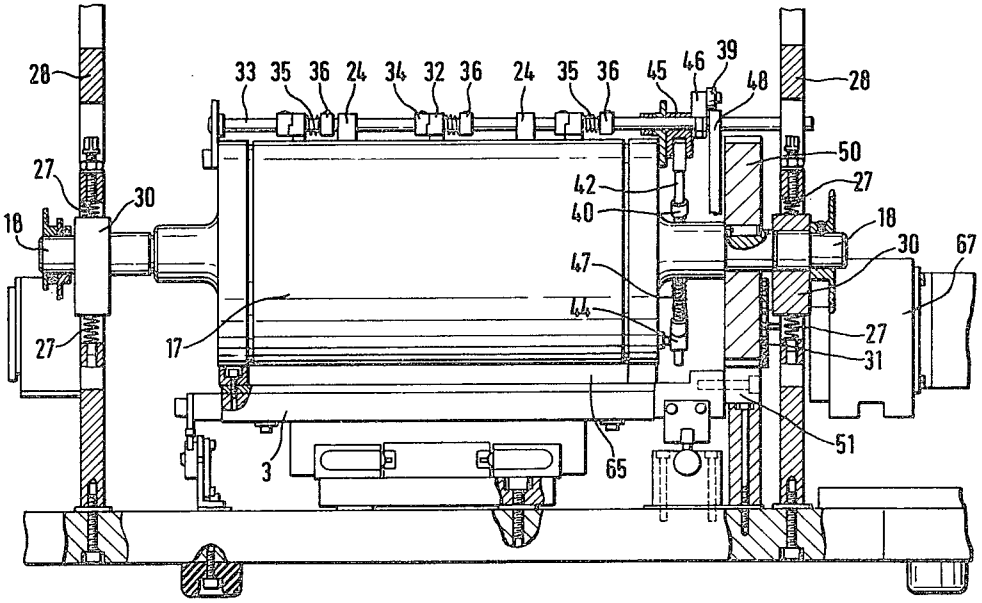
FIG. 1 is a diagrammatic front view of an apparatus for transferring toner images, according to the invention.

The apparatus shown in FIG. 1 is equipped with a transport cylinder 17, the shaft 18 of which is supported with its end portions in links 30 which are displaceably arranged in side plates 28. As can be seen from FIG. 2, the link 30 is contacted by two vertically extending guide rails 29 disposed on either side thereof, and it is adapted to move in the upward and downward direction between these guide rails. In the embodiment shown in FIG. 1, pressure elements, for example pretensioned compression springs 27, are provided above and below the link 30. The compression springs 27 abut the top and bottom surfaces of the link 30 and by their action, the space between the upper surface of an upper part 65 of a travelling table and the shell surface of the transport cylinder 17 adjusts itself differently, according to the thickness of an image carrier 15 (see FIG. 3), since the shaft 18 of the transport cylinder 17 is vertically displaceable against the respective pressures of the springs 27.

Figure 2:
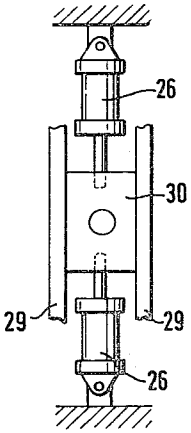
FIG. 2 is a detail of a modified apparatus according to FIG. 1.

As shown in FIG. 2, it is also possible to provide pneumatic cylinders 26 as the pressure elements for the link 30. These pneumatic cylinders are disposed in the side plate 28 above and below the link 30, and their piston rods are connected with the link 30.

A gripping device is arranged on a shaft 33 above the transport cylinder 17 and comprises gripper fingers 32 acting together with coupling pieces 34. Each gripper finger can be closed by means of a leg spring 35 which is positioned between the gripper finger 32 and a locking ring 36. In addition, stops 24 are seated on the shaft 33. Since the gripping device is known in the art, its operation is only briefly mentioned. A control lever 46 of the gripping device carries an actuating roller 39 which rides on a cam 48. The lever 46 is swivelled by the cam 48 and, correspondingly the gripper fingers 32 are opened or closed. A forked piece 45 adjacent to the lever 46 is engaged by a lifting rod 42 which is surrounded by a compression spring 47 resting with one of its ends against an end support 44 and with its other end against a stop 40. The lifting rod 42 and the forked piece 45, as well as the lever 46 together with the actuating roller 39 and the cam 48 are disposed between one end face of the transport cylinder 17 and the inner side of one of the side plates 28. Between the lifting rod 42 and the right-hand side plate 28 in FIG. 1, a gear wheel 50 is mounted on the shaft 18 and mates with a rack 51 which is attached laterally to a travelling table 3. The rack 51 is moved to and fro by a gear wheel 31 which is connected to a DC motor 67. Due to the mating of the gear wheel 50 with the rack 51, the transport cylinder 17 is rotated together with the image carrier 15, which may, for example, comprise an aluminum sheet, which is held on the shell surface of the transport cylinder 17 by means of the gripping device.

Figure 3:
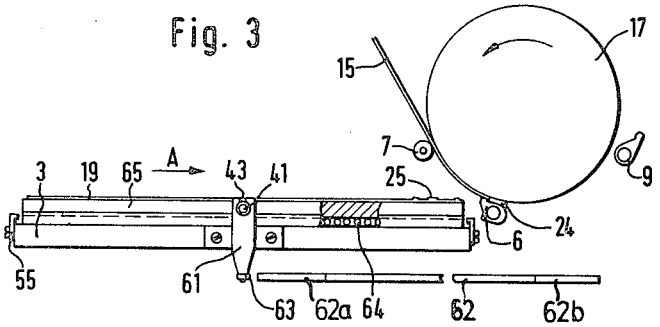
FIG. 3 is a diagrammatic side view of the apparatus according to FIG. 1.

The diagrammatic side view of the apparatus in FIG. 3 shows that two gripping devices 6 and 9 for retaining the image carrier 15 extend across the circumferential surface of the transport cylinder 17. Gripping device 6 secures the leading edge of the image carrier 15 and rotates synchronously with the transport cylinder. Gripping device 9 is arranged on the shell surface of the transport cylinder at a distance from gripping device 6. This distance is determined by the given length of the image carrier 15. Gripping device 9 serves to hold the rear edge of the image carrier 15 so that the latter is clamped to the circumferential surface of the transport cylinder 17. Ahead of the point of contact between the transport cylinder 17 and the image carrier 15, a pressure roller 7 is provided, which urges the image carrier in the direction of the circumferential surface of the cylinder.

The image carriers 15 are preferably comprised of metal sheets, for example, aluminum sheets which may have thicknesses ranging from 0.1 to 0.5 mm. The strip material available for the preparation of such aluminum sheets has thickness tolerances, according to DIN standards, which may be in the range between ± 0.008 mm for a 0.1 mm thick aluminum sheet and between ± 0.08 mm for a 0.5 mm thick aluminum sheet. If an aluminum sheet of 370 mm length is passed through the apparatus, this involves deviations due to tolerances, which amount to ± 0.3 mm over the path length, for a 0.5 mm thick aluminum sheet.

As shown in FIG. 3, the travelling table 3 and an upper part 65 of the travelling table are arranged in superposed position and are moved towards the transport cylinder 17 in the direction of an arrow A. A photoconductive reproduction material, for example, a photoconductor 19, which carries a toner image 25 is held on the upper surface of the upper part 65 of the travelling table. While the travelling table 3 is moved forward up to the point of transfer of the toner image to the image carrier 15, the upper part 65 of the travelling table is firmly connected with the travelling table 3 via locking members 53, 54, 57 and 58 (see FIGS. 4 and 5). Rolling members 64 are arranged between the travelling table 3 and the upper part 65 of the travelling table. A control lever 61 is provided with a cut-out 43 (see FIG. 6) which accommodates a centering pin 53, the function of which will be described in detail below. The centering pin 53 has a thread onto which a nut and lock nut 41 are screwed, which prevent the pin 53 from slipping out of the cut-out 43. To limit the movement of the upper part 65 of the travelling table, stop ledges 55 are attached to either side wall of the travelling table 3. An actuating bar 62 for the lever 61 is positioned underneath the travelling table 3. On the lower end of the lever 61 a roller 63 is mounted, which comprises, for example, a ball bearing.

As soon as the toner image 25 on the photocontuctor 19 enters into the pressure contact with the image carrier 15, the transport cylinder 17 retaining the image carrier 15, starts to roll over the photoconductor 19. In the process, the toner image is transferred under pressure from the photoconductor 19 to the image carrier 15. An image transfer without losses in image quality and with high resolution, requires an absolutely synchronous running between the photoconductor 19 which is fastened to the upper part 65 of the travelling table and the circumferential surface consisting of the transport cylinder 17 and the aluminum sheet 15 clamped thereto. The rolling radius which is made up of the radius of the transport cylinder 17 and the thickness of the aluminum sheet 15 must, therefore, be equal to the radius of the pitch circle of the driving gear wheel 50 of the transport cylinder. There are, additionally, the abovementioned different path lengths with result from the permissible variations in the thicknesses of the aluminum sheets and which act as braking or accelerating forces, exerted by the aluminum sheet 15 on the photoconductor 19. These forces give rise to stresses between the aluminum sheet 15 and the photoconductor 19 and may lead to losses in resolution, in the case of greater format lengths and, in addition, during the return of the upper part 65, also to damage and increased wear occurring between the surfaces of the upper part 65 of the travelling table, due to the reduced rolling radius. Synchronous running between the transport cylinder 17 carrying the aluminum sheet and the upper part 65 of the travelling table during pressure contact between these two structural members ensures that the above-described damage cannot occur.

The devices which synchronize the linear speed of the upper part 65 of the travelling table with the circumferential speed of the image carrier 15 on the rotating transport cylinder 17 and the mode of operation of these devices are described with references to FIGS. 4 to 7.

Figure 4:
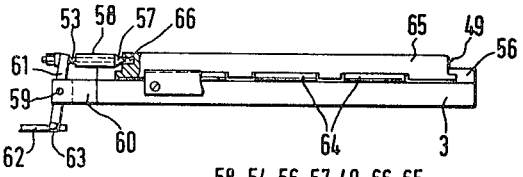
FIG. 4 shows a travelling table and an upper part of the travelling table with means for synchronizing the rates of motion of the photoconductive surface and the image carrier.

FIG. 4 shows, in a diagrammatic view, the travelling table 3 which is locked with the upper part 65 of the travelling table, while the travelling table 3 moves in the direction A towards the transport cylinder 17. For this purpose, locking members are provided including the centering pin 53 carrying a centering cone 57, a guide 58 for the centering pin 53 and a compression spring 54 surrounding the centering pin. The upper part 65 of the travelling table has a bore 66 which points in the direction of forward motion A, the centering cone 57 engages this bore 66 during the forward motion of the travelling table 3 and locks it with the upper part 65 of the travelling table. As a result, the travelling table 3 and the upper part 65 of the travelling table are rigidly connected with each other and are axially centered during their forward motion.

The compression spring 54 is arranged in the interior of the guide 58 and rests with one of its ends against the bottom of the centering cone 57 and with its other end against a stop face in the guide 58. On either side of the upper part 65 of the travelling table in the direction of forward motion A, guide ledges 56 are provided, which are attached to the travelling table 3. These guide ledges 56 are complementary in shape to stepped side faces 49 of the upper part 65 of the travelling table and engage these side faces so that the upper part 65 of the travelling table is very accurately guided by the guide ledges 56.

Figure 6:
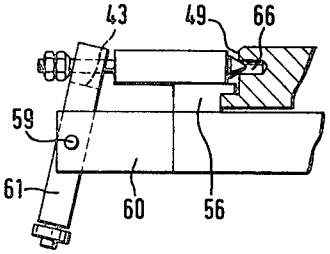
FIG. 6 shows the means according to FIG. 4 in the closed state.
Figure 7:
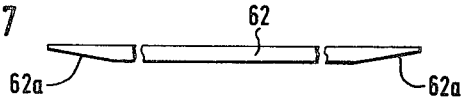
FIG. 7 is a detail showing a structural member of the apparatus according to FIGS. 3 and 5.

FIG. 6 shows details of the travelling table 3 and the upper part 65 of the travelling table in the locked state. A fixture 60 is disposed on one side of the travelling table, to which a pivoting lever 61 is hinged. The lever 61 moves the centering pin 53 forward and backward in the guide 58 which is stationarily seated on the guide ledge 56. The lever 61 is adapted to pivot on an axle pin 59 in the fixture 60.

As soon as the front edge of the upper part 65 of the travelling table contacts the transport cylinder 17 to which the aluminum sheet is clamped and which has the lowest point on its circumference below the surface of the upper part 65 of the travelling table, the transport cylinder 17 carrying the aluminum sheet is forcibly lifted by the upper part 65 of the travelling table. This is rendered possible by the elastic mounting of the shaft 18 of the transport cylinder 17 by means of the links 30 in the side plates 28 of the apparatus.

Figure 5:
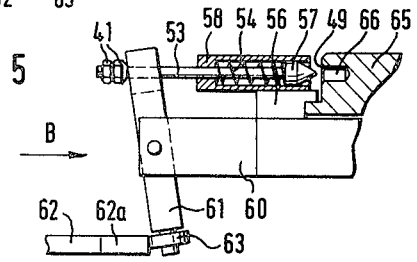
FIG. 5 shows the means according to FIG. 4 in the open state.

At this time, the locked state between the travelling table 3 and the upper part 65 of the travelling table is released, as shown in FIG. 5. This is effected in such a way that the roller 63 which is seated on the lower end of the lever 61 and which has an axis of rotation which is in alignment with the longitudinal axis of the lever 61, rides upon the running surface of the actuating bar 62 while the travelling table 3 continues in its forward motion. The actuating bar 62 is fixed in relation to the table 3 and transport cylinder 17 at a distance selected to ensure unlatching at the desired contact time of the cylinder 17 with the upper part 65 of the travelling table. The actuating bar 62 which is diagrammatically shown in FIG. 7, has bevelled ends **62*a* which facilitate the mounting of the roller 63 on the actuating bar 62. The lever 61 is thereby displaced in the transverse direction B with respect to the travelling table 3 and, as a result, the centering cone 57 is retracted from the bore 66 so that the upper part 65 of the travelling table and the travelling table 3 are unlocked. From this moment on, the upper part 65 of travelling table 3 is advanced solely by the given rolling radius which is made up of the radius of the transport cylinder 17 and the thickness of the image carrier, e.g., the aluminum sheet, respectively. The travelling table 3, after unlocking, continues to move at its predetermined speed corresponding to the propulsion of the rack 51, whereas the upper part 65 of the travelling table adopts a speed corresponding to the given rolling radius. This is rendered possible, because the upper part 65 of the travelling table 3 is easily displaceable with respect to the travelling table 3, as a result of the rolling contact effected by the rolling members 64**.

After completion of the image transfer from the photoconductor 19 to the aluminum sheet, the roller 63 rolls off the bevelled end **62*a* at the rear of the actuating bar 62 and, as a result, the tensioned compression spring 54 forces the centering pin 53 and thus also the centering cone 57 in the direction of the conical bore 66 in the upper part 65 of the travelling table. The centering pin 53 is thus centered and locks the travelling table 3 with the upper part 65 of the travelling table, as in the starting position. The direction of motion of the travelling table is then reversed and it is returned to its starting position. When the photoconductor 19 or the upper part 65 of the travelling table 3, respectively, contacts the transport cylinder 17 in the reverse movement, the travelling table 3 and the upper part 65 of the travelling table 3 are unlocked and the latter is moved back at a speed which adjusts itself according to the rolling radius of the transport cylinder 17**, which moves opposite to the direction of rotation during image transfer.

As soon as the entire travelling table 3 has passed the transport cylinder 17, it is again automatically locked with the upper part 65 of the travelling table 3 and reaches its starting position in the locked state. It is then possible to generate a latent charge image by exposure of the photoconductor 19 and develop this latent image by means of a toner. This new toner image can again be transferred to a fresh image carrier 15 in the above-described manner.

I claim:

1. Apparatus for transferring toner images from a moving photoconductor to an image carrier comprising:

(a) a cylinder mounted for rotation, (b) means for securing at least a portion of said image carrier about the circumferential surface of said cylinder, (c) a support table having an upper portion thereof supporting said photoconductor, said upper portion movable in a linear fashion adjacent said cylinder, (d) means for mounting said cylinder and table for pressure contacting said image carrier and said photoconductor upon movement of said upper portion of said table, and (e) means for synchronizing the linear speed of said upper portion of said table with the tangential speed of said image carrier secured to said cylinder.

2. Apparatus as recited in claim 1 wherein said upper portion of said table is relatively moveable with respect to said table.

3. Apparatus as recited in claim 2 further comprising rolling members positioned between said table and upper portion.

4. Apparatus as recited in claim 2 wherein said synchronizing means comprises a gear wheel mounted for rotation with said cylinder and a mating rack mounted to said table.

5. Apparatus as recited in claim 4 wherein said synchronizing means further comprises a latch mechanism locking said table and upper portion together to prevent relative movement and means for unlocking said latch mechanism for permitting relative movement of said table and upper portion.

6. Apparatus as recited in claim 5 wherein said unlocking means is operative at a time when said image carrier secured to said cylinder comes into contact with said photoconductor supported on said upper portion of said table whereby said image carrier and said photoconductor move at the same speed at the point of pressure contacting.

7. Apparatus as recited in claim 4 wherein said latch mechanism comprises a centering pin, a centering cone mounted to an end of the centering pin, a guide member for guiding said centering pin, means for urging said centering pin into contact with said upper portion, and means for connecting said centering pin to said table.

8. Apparatus as recited in claim 7 wherein said upper portion of said table is provided with a bore for receiving at least a portion of said centering cone and wherein said pin is mounted at least partially within said guide member, said urging means comprises a spring surrounding said centering pin and having one end resting against said centering cone and another end contacting a surface of said guide member opposed to said centering cone.

9. Apparatus as recited in claim 7 wherein said unlocking means comprises a lever attached to said centering pin and pivotably secured to said table, and an actuating bar fixed in relation to said table and positioned to contact said lever for pivoting said lever in opposition to said urging means upon contact of said photoconductor and image carrier.

10. Apparatus as recited in claim 9 further comprising guide ledges attached to said table and contacting said upper portion for guiding said upper portion relative to said table.

11. Apparatus as recited in claim 9 further comprising a roller mounted for rotation in alignment with the longitudinal axis of said lever, said roller positioned for contacting said actuating bar during unlocking of said latching mechanism.

12. Apparatus as recited in claim 11 wherein said actuating bar is fixed in a position underneath and parallel to the table, said lever pivoted transverse to the direction of travel of said table.

13. Apparatus as recited in claim 12 wherein said actuating bar has bevelled end portions for facilitating engagement of said roller and actuating bar.

14. Apparatus as recited in claims 1 or 9 wherein said cylinder is mounted on a shaft, said shaft being supported by links mounted for vertical displacement between guide rails.

15. Apparatus as recited in claim 14 further comprising pressure elements connected with said links.

16. Apparatus as recited in claim 15 wherein said pressure elements comprise pneumatic cylinders.

17. Apparatus as recited in claim 14 wherein said pressure elements comprise pretensioned compression springs.

* * * * *